United States Patent [19]

Halsey et al.

[11] 4,110,824

[45] Aug. 29, 1978

[54] METHOD AND APPARATUS FOR CONTINUOUSLY PROCESSING STRAND

[75] Inventors: Homer P. Halsey; Lowell E. Reed, both of Poland Township, Mahoning County; David C. Hildebrand, Boardman Township, Mahoning County, all of Ohio

[73] Assignee: Youngstown Sheet and Tube Company, Youngstown, Ohio

[21] Appl. No.: 798,146

[22] Filed: May 18, 1977

[51] Int. Cl.[2] ..... B65H 25/20; G06F 15/20

[52] U.S. Cl. ..... 364/472; 228/103; 242/75.51

[58] Field of Search ..... 242/78.1, 75.51; 364/472, 469; 228/103; 72/6

[56] References Cited

U.S. PATENT DOCUMENTS

| | | | |
|---|---|---|---|
| 3,365,144 | 1/1968 | Daub | 242/78.1 |
| 3,587,276 | 6/1971 | Randich | 72/227 |
| 3,610,546 | 10/1971 | McGorry | 242/57.1 |
| 3,687,389 | 8/1972 | Adams | 242/75.51 X |
| 3,722,251 | 3/1973 | Withrow | 72/294 |
| 3,875,774 | 4/1975 | Kamata, et al. | 72/6 |
| 3,888,430 | 6/1975 | Costello, et al. | 242/78.6 X |
| 3,890,547 | 6/1975 | Keck | 242/75.51 X |
| 3,953,713 | 4/1976 | Ligt | 235/151.32 X |
| 3,979,080 | 9/1976 | Herbert, et al. | 242/78.6 |

*Primary Examiner*—Edward J. Wise
*Attorney, Agent, or Firm*—John Stelmah

[57] ABSTRACT

Method and apparatus for processing continuous strand material in a continuous processing line wherein movement of the strand is continued at a subsequent processing station despite halting movement of the strand at a preceding station and for providing an indication of when the portion of the strand present at the preceding station when halted reaches the subsequent processing station or position.

15 Claims, 5 Drawing Figures

NOTES:

Individual interrupts are automatically disabled each time they occur.

Pulse Counts B, C, and D correspond to the distances from the Workstation WS to the Processing Station PS when the movable car is at switch position $S_B$, $S_C$, or $S_D$, respectively.

$S_W$ = switch at Workstation WS

METHOD AND APPARATUS FOR CONTINUOUSLY PROCESSING STRAND

BACKGROUND OF THE INVENTION

This invention relates generally to method and apparatus for processing strand material in a processing line having a plurality of stations where work is sequentially performed and particularly in a processing line wherein movement of the strand is continued at a processing station despite halting movement of the strand at another processing station. The invention particularly relates to method and apparatus for indicating when a portion of the strand processed at a first processing station reaches a preselected location in the processing line downstream of said first processing station.

The features of this invention are particularly adapted for use in conjunction with a steel continuous strip annealing line wherein it is necessary to stop a portion of the line in order to attach the leading end of a new steel coil to the trailing end of a preceding steel coil in the line and wherein it is useful to know when the juncture of the two coils reaches a preselected control location downstream of the work station and of a strip accumulator.

While the features of this invention are particularly adapted for use with a continuous strip processing line, it will be apparent that they may be employed in conjunction with other forms of strand material, for example, but not limited to, wire, band, tape, etc. It will be understood that the term "strand," as used herein, may encompass one or a plurality of lengths of strand material and that the lengths may be of random or preselected sizes.

In a continuous strip steel processing line where coils of steel strip are joined end-to-end, it is desirable to know when the beginning of a new coil strip approaches or enters a processing section, particularly when the new coil strip has physical characteristics different from the preceding coil strip. Such knowledge enables process control changes to be applied as the new coil strip enters the processing section. For example, it may be desirable to change the line speed as a strip of different thickness enters an annealing furnace.

It is known in the art to use a looper or other accumulator means ahead of a processing section, where the strip can not be feasibly stopped, e.g. in an annealing furnace wherein stopping of the strip would be detrimental to the quality of the strip. To facilitate continuous movement of the strip through the annealing furnace it is necessary to join, as by welding, coils of steel in end-to-end fashion. However, in order to carry out the joining process, movement of the trailing edge of a first coil must be halted while a leading edge of a second coil is being joined to the first coil. Thus the entry looper in a continuous strip line permits the strip in the annealing furnace section to continue running while the strip at the joining station is stopped.

It is also known in the art to provide methods of detecting the weld between contiguous strips when the weld reaches a downstream location in the processing line. One of the methods comprises punching a hole adjacent to the weld and detecting the hole at the downstream point by means of a light source and photoelectric cell. A disadvantage of such method, in addition to having to punch the holes, is that the hole punching and detection apparatus require considerable maintenance. Another system which has been employed involves the use of thickness variation detection devices; however, a disadvantage of such systems is that they are prone to give false signals when severe buckles are encountered in the strips.

OBJECTS AND SUMMARY OF THE INVENTION

It is an object of this invention to provide method and apparatus for transmitting a first signal indicating when a portion of a continuous strand is stopped at a first location and for transmitting a second signal indicating when said portion has reached a second location in a continuous strand processing line.

It is an object of this invention to provide method and apparatus for processing continuous strip material made up of random lengths joined in end-to-end fashion on a line having a plurality of processing sections, including accumulator means between sections, and for providing an indication when the part of a strip processed at a work station approaches a subsequent work station or section in the line. It is another object of this invention to provide method and apparatus for indicating the presence of a leading end of a length of strip processed at a first station of a processing line as the leading end approaches a subsequent processing station. It is a further object of this invention to provide method and apparatus for transmitting a control signal responsive to the location of the leading end of a length of strip material in a continuous strip processing line.

The objects of this invention are attained by providing in a continuous strand processing line, which line includes a work station, an accumulator section having a positionable accumulator, and a processing section downstream of the accumulator section, method and apparatus utilizing means for indicating that movement of the strand has halted and work is being performed at the work station, means for detecting the position of the accumulator along its positioning path at the time work is being performed at the work station and generating a strand path signal representative of the length of the strand path between a preselected position in the processing section and the work station, means for measuring a parameter which is a function of the length of strand passing a measuring point, which measurement may be in the form of integrating the velocity of the strand, and generating a strand length signal corresponding to the measured strand length, and means for comparing the strand path signal with the strand length signal and generating a new signal when the strand path and strand length signals correspond.

DESCRIPTION OF THE DRAWING

The invention will be more fully understood and further objects and advantages thereof will become apparent when reference is made to the following detailed description and to the accompanying drawing, in which.

It is to be noted in FIG. 2, as well as the other disclosed embodiments, that corresponding parts have corresponding numerals but letter suffixes have been added.

Figure 1:
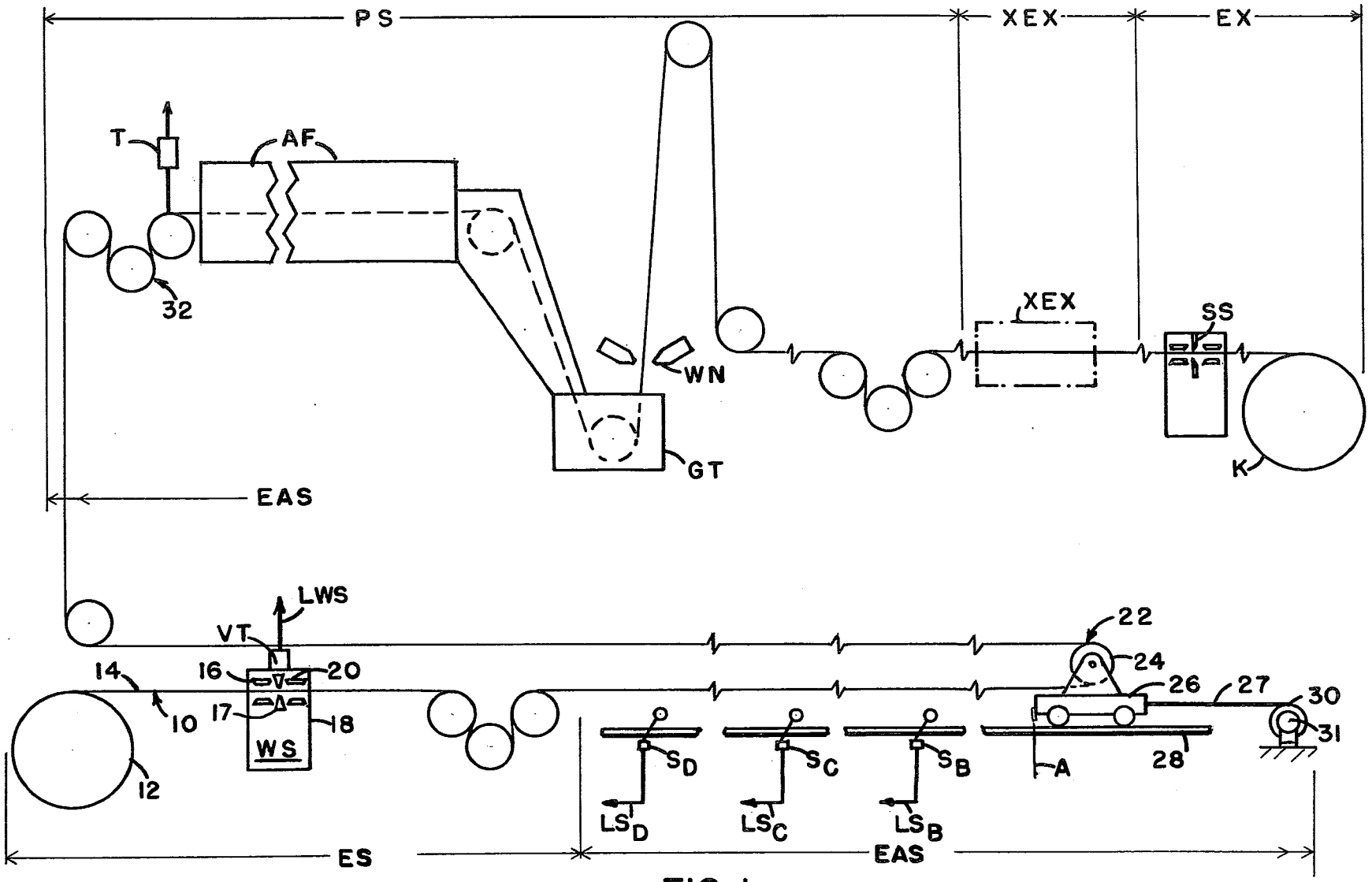
FIG. 1 is schematic representation of a continuous processing line for the annealing and galvanizing of continuous steel strip and which embodies some aspects of the invention.

A representative embodiment of apparatus forming a part of this invention is schematically illustrated in FIG. 1, wherein the strand processing line is generally designated by the reference numeral 10 and is shown as comprising a continuous line for processing steel strip for galvanizing. Each of the computation circuitry embodiments, CC-V, CC-D, and CC-C, illustrated in FIGS. 2, 3, and 4, respectively, and later to be described, is adapted for use with the line 10.

The line 10, as shown, generally comprises five basic sections: (2) an entry section ES; (2) an entry accumulator section EAS; (3) a processing section PS; (4) an exit accumulator section XEX; and (5) an exit section EX. The division of the processing line into the designated sections is somewhat arbitrary; however, the sections may include components which peform the functions now to be described.

The entry section ES may be considered to generally include those components that provide coils of strip and facilitate the feeding of the strip, such as uncoilers, clamps, joiners, etc.

The accumulator section EAS is normally considered to be part of an entry section of the processing line; however, in order to facilitate the description herein, the accumulator means is separately designated as entry accumulator section EAS and is considered to include those components which facilitate the accumulation of sufficient strip so that movement of the strip may be continued in a downstream processing location or section despite halting movement in an upstream location or section.

The processing section PS may be considered to include those components which perform processing steps upon the strip such as by way of example, but not limitation, heating, coating, and cooling.

The exit accumulator section XEX may be similar in form to section EAS and consequently for convenience is simply shown as a block diagram.

The exit setion EX may be considered to generally include those components that facilitate the removal of the strip from the strip line, such as shears, clamps, pinch rolls, and coilers.

In FIG. 1 there is shown a payoff coil 12 suitably supported for feeding strip 14 to the line 10. The strip 14 passes through a work station WS including normally open clamp 16, strip joiner 17, and exit clamp 20. The joiner 17 may be any suitable device, such as a splicer or welder, which will attach the leading end of a new coil to the trailing end of a preceding coil. From the joiner 17 the strip 14 passes through another clamp 20. The function of the clamp 20 is to hold the trailing end of a coil while adding a new coil and joining the ends of the coils. The function of the clamp 16 is to hold the leading end of the new coil in suitable position for joining with the expended coil. The work station 18 is connected through suitable switches and circuitry to the computation circuitry designated generally by the block diagram CC. The various embodiments of the computation circuitry are further designated by letter suffixes to the block diagram designation, i.e., CC-V, CC-D, and CC-C. Associated with the work station WS is transmitting means VT for transmitting a signal whenever work is being conducted at the work station. As an example, switches $W_s$ (not shown) may be used in conjunction with or built into a joiner, which switches close whenever the joiner goes into operation.

The strip 14 passes from clamp 20 to the accumulator, generally designated by reference numeral 22. The accumulator 22, as shown, includes a rotatable drum 24 mounted on movable car 26 riding on rails 28. During normal line running conditions the movable car is held in the full acumulative relative position as shown. The function of the accumulator 22 is to provide sufficient strip 14 between the entry section ES and the processing section PS for the strip to continue running through the stations of the processing section, such as the annealing furnace AF, galvanizing tank GT, wiping nozzle WN, etc., even though the strip is stopped in the entry section. The accumulator 22 may be suitably controlled through control of the movement of the car 26. The car 26 is connected to a cable 27 windable about revolvable drum 30 driven by electric motor means 31. When the strand 14 is stopped at the work station WS the strand tension will increase and cause the car 26 and drum 24 to move toward the work station WS and thereby the accumulated strand will be expended.

It will be understood that the accumulator may be in a form other than illustrated here, for example, it might take the form of a telescoping hydraulic piston and cylinder arrangement and/or be vertically disposed. In the case of a piston/cylinder arrangement carrying a reversing roll corresponding to roll 24 the acumulator would be self-restraining and therefore would not require separate restraining means such as drum 30 and cable 27.

Figure 2:
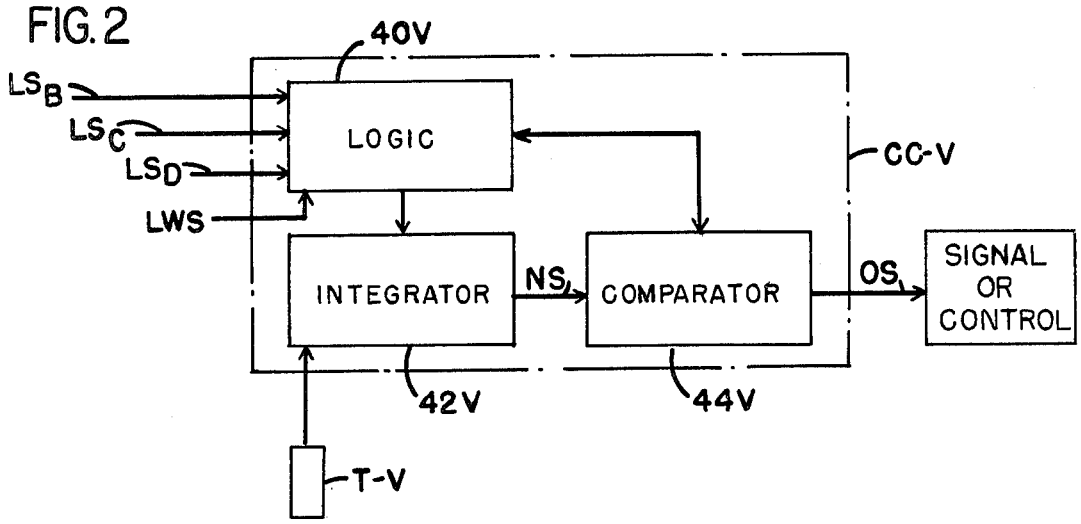
FIG. 2 is a block diagram of one embodiment of computation circuitry which when combined with the features shown in FIG. 1 provides a showing of one form of the invention.

The strip 14 is driven through the accumulator 22 by means of bridle rolls 32 to the processing section PS. There is provided at one of the rolls 32 at the entrance of the processing section strip movement indication means T to provide an indication of the strip movement, length or velocity, to the processing section. In FIG. 2 such means T is designated as velocity measuring means in the form of tachometer T-V.

During normal operation, the velocity of the strip through entry section corresponds to the velocity of the strip through the processing section and the accumulator car 26 is relatively stationary at location A on the rails 28. As the strip slows down in the entry section in preparation for joining, the accumulator car starts to move from location A toward location B where switch means $S_B$ is located. Closing of the switch $S_B$ generates a signal via line $LS_B$ to the logic section 40 of the computation circuitry CC. Likewise, whenever work is being done at the work station a signal will be transmitted via line LWS to the logic section 40. If a joint is being made at the time the carrying means (car 26 carrying the turn roll or drum 24) passes switch means $S_B$ then, depending upon whether strand velocity measuring means or strand length measuring means is employed, either device 42-V or 42-D will be activated.

From an understanding of the general purpose and functioning of the logic circuitry, a person skilled in the art can develop a number of ways of performing such functions, including a program which whil enable a digital computer to carry out the functioning. As indicated above, it is the general functioning of the logic section (which may be incorporated in a digital computer) to receive a signal from a position switch S and a separate signal from the work station WS and, when such signals are simultaneously received, generate a signal to integrating device 42-V or pulse counter 42-D (or the digital computer). In addition, it is the function of the logic sub-section 40 to have set therein fixed voltages, each corresponding to the strand path distance from the work station WS to the preselected downstream location at the time the respective position switch S is activated, and once the system is activated, it is also the function of the logic subsection 40 to ignore other switch S closures until such time the strand portion present at the work station WS when the system was activated reaches the preselected downstream position. At that time the logic sub-section 40 will receive a signal from the computer and the system will be reset.

It is indicated in U.S. Pat. No. 3,081,654 that memory logic devices per se are well known to persons skilled in the art. U.S. Pat. No. 3,089,365 also indicates that the operation of NOR logic devices per se are believed to be well known to persons skilled in this art. In addition, there are textbooks which can be referred to as aids in developing logic circuits, e.g., "Handbook of Logic Circuits," published in 1972 by Reston Publishing Company, Inc., Reston, Virginia.

The operation of the system will now be described in conjunction with velocity measuring means and with the computation circuitry such as shown in FIG. 2.

The computation circuitry CC in this embodiment of the invention wherein the velocity of the strand movement in the processing section is measured is further designated by the suffix letter V, as CC-V. In such case, the strand velocity may be measured by a D. C. tachometer T-V in or at the entrance to the processing section. The computation circuitry CC-V may be considered to be generally comprised of three sub-sections, namely a logic sub-section 40-V, an integrator sub-section 42-V, and one or more comparator sub-sections 44-V. Each comparator sub-section 44-V issues a signal whenever the preset voltage set by the logic sub-section 40-V is matched by the voltage issued by the integrator sub-section 42-V as compared by the comparator sub-section 44-V.

When the integrating device 42-V is activated, a comparator device 44-V is also activated and set with a fixed voltage proportional to and corresponding to the length of the strip path between the joiner 17 and a preselected position or station, e.g., the entrance to the processing section PS. The length of strip between these work stations, joiner 17 and the entrance to the processing section PS, is always the same whenever the carrying means 26 passes switch $S_B$. Integrator device 42-V integrates the voltage signal generated by velocity measuring means T-V, which signal is proportional to and indicative of the strip velocity through the processing section PS.

If the joining cycle has not started when the carrying means 26 passes switch $S_B$ then neither the integrating device 42-V nor the comparator 44-V will be activated. If the joining cycle has not started when the carrying means passes switch $S_B$ but has started or starts when the carrying means passes switch $S_C$, then the comparator 44-V will be activated by a different fixed voltage corresponding to the length of strip path between the joiner 17 and the preselected down stream position, such as the entrance to the processing section PS, when the carrying means 26 passes switch $S_C$ and the integrator 42-V will be activated.

In similar fashion, additional switches such as $S_D$, etc., or other sensing means, may be incorporated in the line along the path of the carrying means 26 and in like fashion the comparator 44-V will be set with a voltage representing the length of the strip path between the joiner 17 and the preselected position at the time the carrying means activates the corresponding sensing means.

After the integrator 42-V has been activated by a particular switch and the corresponding fixed voltage has been set on the comparator 44-V, the logic circuit system 40-V ignores other switch closures until the joint, made at the time the said particular switch activated the integrator 42-V, is at the preselected position, i.e., the entrance to the processing section PS. At that time, an output signal OS is generated and the system resets itself. The generated output voltage signal may be used to provide an audible and/or visual signal indicating that the joint has reached a preselected position of the processing section and/or as a control for varying or maintaining a controllable processing step in the processing line.

The output voltage of the integrator 42-V is always directly proportional to the distance the strip moves after the carrying means activates the switch that initiated the integrating or strand measuring cycle. When the integrator output voltage equals the fixed voltage set on the comparator 44-V, the comparator generates the system output voltage signal OS.

It will be understood that additional comparisons may be used in the system to provide indications when a particular joint approaches or reaches any one or more locations in the processing line, such as the galvanizing tank GT, strip shear SS, coiler K, etc.

Figure 3:
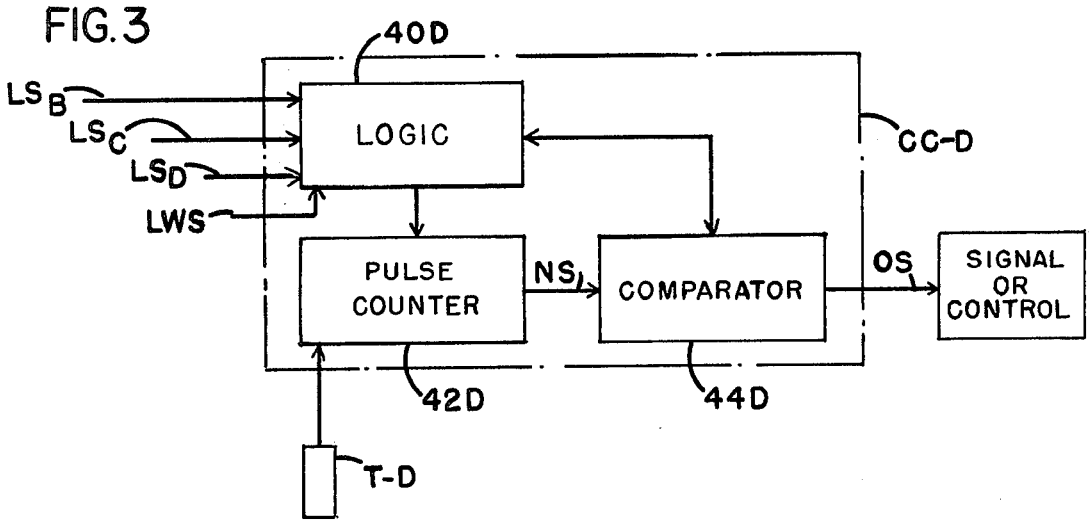
FIG. 3 is a block diagram of another embodiment of computation circuitry which may be combined with the features shown in FIG. 1 and provides a disclosure of another form of the invention.
Figure 4:
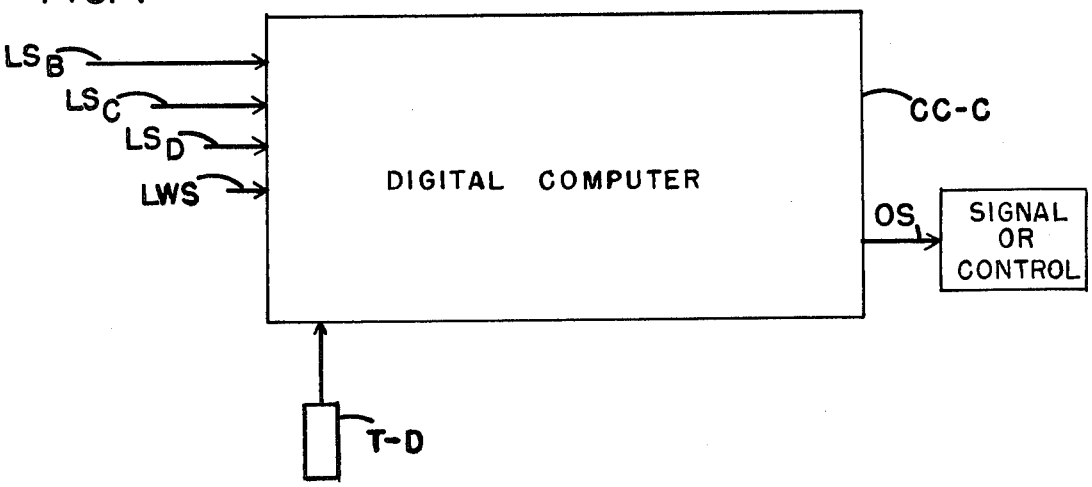
FIG. 4 is a block diagram of a third embodiment of computation circuitry which may be combined with a continuous processing line such as shown in FIG. 1.
Figure 5:
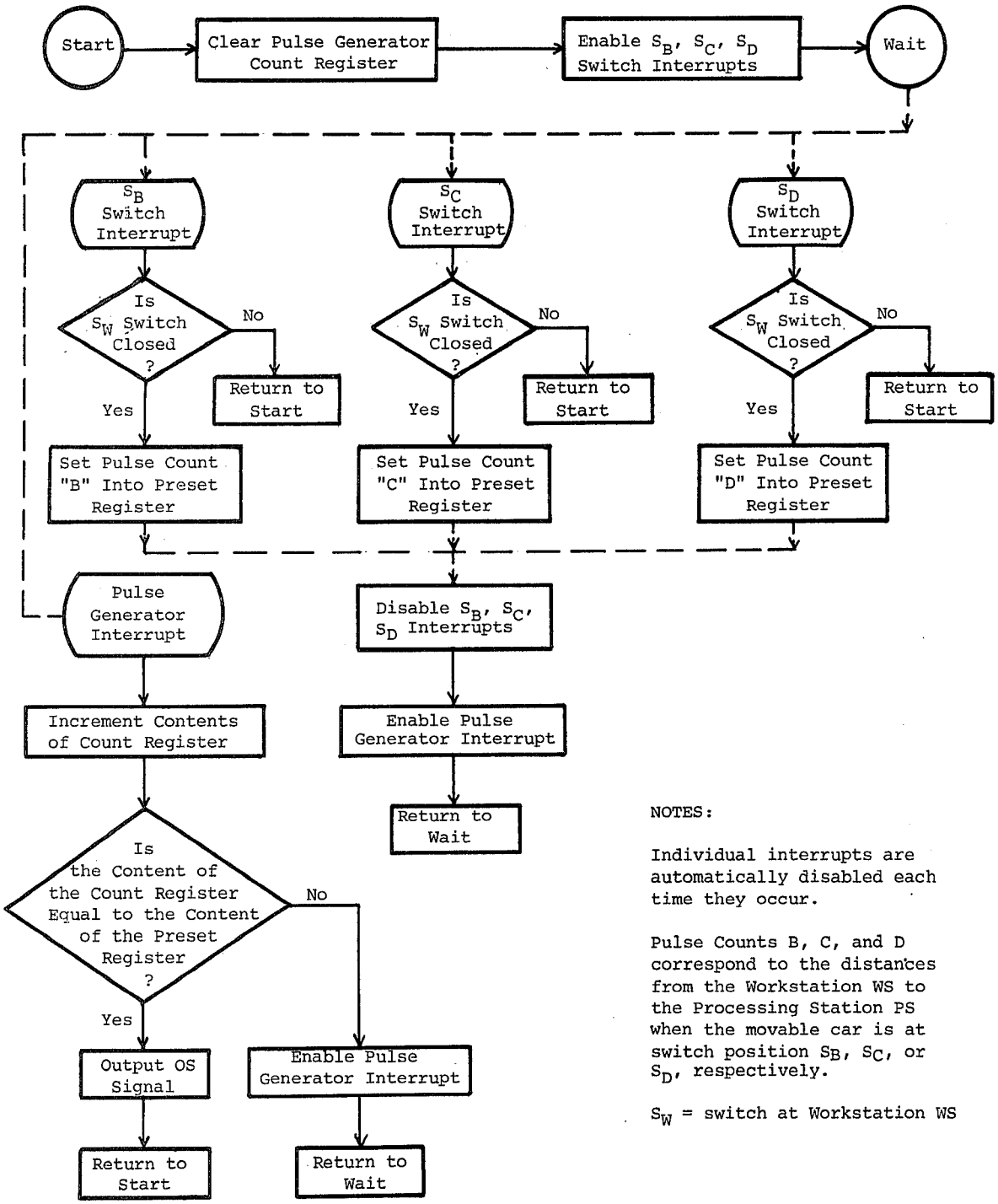
FIG. 5 is a flow diagram of one example of computer programming which may be used to carry out the functions of the computer of FIG. 4.

The operation of the alternate system of computation circuitry as shown in FIG. 3 will now be described. The operation of the FIG. 3 system is substantially the same as that of the FIG. 2 system except that a pulse generator T-D is used in place of tachometer T-V, a counter circuit section 42-D is used to count the pulses generated by pulse generator T-D in place of the integrator circuit section 42-V, and a digital comparator circuit 44-D is used in place of the comparator 44-V.

In the FIG. 3 embodiment of this invention an indication of the strand movement in the processing section may be provided by strand length measuring means such as pulse generator T-D driven by one of the bridle rolls 32 at the entrance to the processing section PS. The pulse generator T-D provides output signals representative of increments of strand length passing over the bridle rolls 32. These signals are received by the pulse counter 42-D in the computation circuitry CC-D and a new signal NS representing the sum of these signals, corresponding to the length of strand passing the bridle rolls 32, is transmitted to the digital comparator sub-section 44-D for comparison with a preset value set by the logic subsection 40-D. The digital comparator 44-D will issue an output signal when the input signal from the counter 42-D matches the preset value, representing the length of strand between the work station WS and the processing section PS at the time the computation circuitry CC-D is actuated by the closing of a switch S when work is being performed at the work station.

After the counter 42-D has been activated by a particular switch and the corresponding fixed value has been set on the digital comparator 44-D, the logic circuit system 40-D ignores other switch closures until the joint, made at the time the said particular switch activated the counter 42-D, is at the preselected position, i.e., the entrance to the processing section PS. At that time, an output signal OS is generated and the system resets itself.

As a second alternative, the hardware of the computation circuitry C-D (used in conjunction with the pulse generator T-D) may be replaced by a digital computer CC-C schematically shown in FIG. 3 and a software program. The form of the computer CC-C may be one of any known in the art that will provide the desired function of producing an output signal when the portion of a continuous strand upon which work is performed reaches processing station subsequent to passing through an accumulator section, and by means of which the functioning of the computer CC-C is initiated by accumulator position detection means, as distinct from initiating a signal solely when work is being done.

The switches S along the accumulator path are illustrated as being in the form of switches $S_B$, $S_C$ and $S_D$ actuable by mechanical contact with an actuator carried by the accumulator. However, it will be understood that other forms of switches may be used, e.g., photocells. The distance between switches and the preferred number of switches may be calculated as follows.

The distance between switches may be determined by the formula $$D_x 32\ V_n T_n/2$$

where:

$D_x$ = maximum distance between switches $V_n$ = minimum velocity of strand through the processing section $T_n$ = minimum work station time.

The minimum number of switches N may be determined by the formula $$D_x N \geqq D_n, \text{ or } N \geqq V_x T_s / V_n T_n,$$

where N is an integer, and $$N - (V_x T_s / V_n T_n) \leqq 1$$

where:

$D_n = V_x T_s/2$ and $D_n$ = minimum distance between the fully accumulated position of the accumulator during normal operation of the line and the switch representing the position of the accumulator in the last switch position in the accumulator path (the one closest to the work station)

$V_x$ = maximum velocity of strand through the processing section $T_S$ = time interval between stopping of strand at the work station and closing of the switch at the work station indicating commencement of the work.

While it is preferred to locate switches S along the travel path of the accumulator, other forms of accumulator position indicating means may also be provided. Such devices may be in the form of means which measure the distance the accumulator moves away from its normal operating position, i.e., the position A when the strand is fully accumulated. The distance measuring means may be in the form of a pulse counter on the drive 31 for the cable drum 30. In such case, or with similar type measuring devices, the counter might issue signal whenever the car 26 moves to positions corresponding to those represented by the switches $S_B$ and $S_C$, etc.

An important aspect of this invention is that the computation circuitry is activated by an accumulator carrier position sensor, such as a switch S, only at such time that work is being performed at work station 18. Such system is distinguishable from other strip length measuring systems which are activated by the initiation of the work cycle at a work station, regardless of the position of the accumulator. Such other systems are often subject to large errors in the measurement of the strip passing from the work station to the processing section. Sometimes the error is as much as 100 feet.

Another important and distinguishing aspect of this invention is that measurement of the strand is a function of the strand velocity in the process section, i.e., of the strand movement downstream of the accumulator section and independent of the speed of the accumulator along its travel path.

From the above description and the drawing it will become apparent that novel method and apparatus have been disclosed for processing continuous strand material, particularly strip material, through successive stations or sections, which might include entry, accumulator, and processing sections, and a work station upstream of the accumulator section, which accumulator section includes a positionable accumulator, and wherein movement of the strand is continued in the processing section despite halting movement of the strand at the work station, the method and apparatus including: position signal means providing a signal representative of the position of the accumulator along its travel path; work signal means providing a signal when work is being conducted at the work station; circuit means receiving the position signal and the work signal and issuing a preset signal corresponding to the length of the strand travel path between the work station and a preselected position in the processing section at the time the position signal is initiated and work is being conducted at the work station, such as the joining of successive strand lengths; strand measuring means measuring the velocity of the strand in the processing section or the length of strand passing to the processing section and issuing a representative signal for comparison with the preset signal in said circuit means; and output signal means issuing an output signal whenever the representative signal corresponds to the preset value and thus indicating that the portion of the strand present at the work station when the position signal was initiated has reached the preselected position in the processing section. It will also be apparent that such method and apparatus is particularly adapted for determining when a welded joint between consecutive strips of steel in a continuous processing line reaches a processing section downstream of a strip accumulator.

What is claimed is:

1. Apparatus for use in conjunction with a continuous strand processing line wherein movement of the strand is continued in one section of the line despite halting movement of the strand in another section to permit work to be performed on the strand in said other section, said line including a work station, an accumulator section having an accumulator movable along a path, and a processing section downstream of said accumulator section, said apparatus comprising:

(1) work signal means issuing a work signal when work is performed at said work station;

(2) accumulator position signal means issuing a position signal representative of the position of said accumulator along its path; and (3) strand signal means for providing a signal for ascertaining the strand length passing into said processing section;

(4) computation circuit means for receiving said work signal and said position signal and including comparison means for comparing a preset value representing the strand path distance between said work station and a preselected position in said processing section, with the length of strand passing into said processing section and issuing a new signal when the length of strand passing into said processing section corresponds to the length of said strand path distance, said comparison means being initiated by a position signal only at such time that said work signal is present.

2. Apparatus as described in claim 1, wherein said strand signal means comprises:

velocity measuring means for measuring the velocity of the strand entering said processing section, and wherein said computation circuit means includes:

(1) a logic section, (2) an integrator section, and (3) a comparator section.

3. Apparatus as described in claim 2, wherein:

said velocity measuring means is in the form of a DC tachometer.

4. Apparatus as described in claim 1, wherein:

said strand signal means comprises strand length measuring means for measuring incremental lengths of the strand entering said processing section, and said computation circuit means includes:

(1) a logic section, (2) a counter section, and (3) a digital comparator section.

5. Apparatus as described in claim 4, wherein:

said strand length measuring means is in the form of a pulse generator.

6. Apparatus as described in claim 1, wherein:

said computation circuit means comprises a digital computer.

7. Apparatus for processing a strip of material in a continuous line wherein movement of the strip is continued in one section of the line despite halting movement of the strip in another section to permit work to be performed on the strip in said other section, said apparatus comprising:

a strip handling line including an entry section having a work station, a processing section, and an accumulator section having a strip accumulator positionable along a path downstream of said work station;

the improvement comprising:

(a) sensor means for sensing the presence of said accumulator at a preselected position along said path;

(b) work signal means for transmitting a signal when work is being performed at said work station;

(c) accumulator position signal means responsive to said sensor means;

(d) strip velocity measuring means upstream of said processing section and transmitting a velocity signal representative of the velocity of the strip passing the measuring point;

(e) computation circuitry means for receiving separate signals from said work signal means, from said accumulator position signal means, and from said strip velocity measuring means;

(f) said computation circuit means including presetting means for setting a voltage to be compared to, which preset voltage is representative of the length of the strip travel path between said work station and said processing section at the time said accumulator position signal means is actuated while work is performed at said work station;

(g) said computation circuit means further including integrator circuit means for integrating the velocity signal means from said strip velocity measuring means and for generating a length output voltage; and (h) said computation circuit means also including comparator circuit means for comparing said length output voltage with said preset voltage and issuing a computation output signal when said output voltage and said preset voltage correspond.

8. Apparatus as described in claim 7, having:

said sensor means at a plurality of preselected positions along the travel path of said accumulator and wherein: the maximum distance between said positions is in accord with the formula $$D_x = V_n T_n / 2$$

where:

$D_x$ = maximum distance between positions $V_n$ = minimum velocity of strand through the processing section $T_n$ = minimum work station time.

9. Apparatus as described in claim 7, having:

said sensor means at a plurality of preselected positions along the travel path of said accumulator and wherein:

the minimum number of positions N is in accord with the formula $$D_x N \geqq D_n, \text{ or } N \geqq V_x T_s / V_n T_n,$$

where N is an integer, and $$N - (V_x T_s / V_n T_n) \geqq 1$$

where:

$D_n = V_x T_s / 2$ $D_n$ = minimum distance between the fully accumulated position of the accumulator during normal operation of the line and sensor means representing the position of the accumulator in the last sensing position in the accumulator path, $V_x$ = maximum velocity of strand through the processing section, $T_S$ = time interval between stopping of strand at the work station and commencement of the work, $D_x$ = maximum distance between positions, $V_n$ = minimum velocity of strand through the processing section, and $T_n$ = minimum work station time.

10. Apparatus for processing a strip of steel through a continuous annealing section wherein movement of the strip is continued despite halting movement of the strip in another section of the apparatus to permit successive strips to be joined together, comprising:

a strip handling line including an entry section, a processing section, and an accumulator section ahead of said processing section;

a joiner station at said entry section;

joiner signal means issuing a joiner signal when strips are being joined at said joiner station;

a positionable accumulator downstream of said joiner station;

position indicator means for detecting the position of the accumulator in the accumulator section and for transmitting a signal when the presence of said accumulator is detected at a preselected position;

logic circuit means for receiving said signal from said indicator means;

comparator circuit means for receiving a signal from said logic circuit means and setting a preset voltage value to be compared to; said preset voltage value being representative of the length of strip between said joiner station and said processing section at the time when strips are being joined and said signal means is actuated by said position indicator means;

strip velocity measuring means upstream of said annealing section and transmitting a signal representative of the strip velocity passing into the annealing section; and integrator circuit means for integrating the signal from said strip velocity measuring means and transmitting a voltage signal to said comparator circuit means for comparison with said preset voltage value;

said comparator circuit means including means for transmitting a signal when the signal from said integrator circuit means corresponds to said preset voltage value.

11. Apparatus for indicating when a weld between consecutive strands made at a welding station on a continuous processing line reaches a preselected position subsequent to and downstream of said welding station, which apparatus comprises (a) means for measuring the velocity of said strand at said subsequent position;

(b) work indication means for indicating when a weld is being performed on said strands at said welding station;

(c) looping means for accumulating a reserve of said strand to maintain movement of said strand past said subsequent position even though the strand at said welding station is not moving;

(d) circuit initiating switch means actuatable by movement of said looping means, said switch means being at a fixed distance from said subsequent position;

(e) electric circuit logic means for receiving a signal from said switch means and from said work indication means, said logic means also setting a fixed voltage corresponding to the length of strand between said welding station and said subsequent position at the time said switch means is actuated;

(f) integrator means actuated by said switch means for integrating the velocity of said strand as the strand moves through said subsequent position and generating a corresponding voltage; and (g) comparator circuit means indicating when the voltage from said integrator means corresponds to the fixed voltage of said logic circuitry means.

12. Apparatus as described in claim 11, which further comprises:

additional switch means actuable by movement of said looping means, each of said additional switch means being at a different fixed distance from said subsequent position, and wherein:

said electric circuit logic means is capable of receiving a signal from each of said switch means, and said integrator means is capable of being actuated by any of said switch means if and when a weld is being made at said welding station when the actuating movement occurs at a particular switch means, providing said integrator means has not been previously actuated during the welding step taking place.

13. Apparatus for indicating when a strip passing over a variable path distance between two spaced locations reaches the second of said locations, which apparatus comprises:

(a) strip accumulator means movable along a path;

(b) first signal means for transmitting a signal when said strip is stopped at the first of said locations;

(c) second signal means for transmitting a position signal representative of the position of said accumulator means along its path and representative of the length of strip between said locations;

(d) measuring means for obtaining electrical signals and transmitting a signal representative of the velocity of strip passing the second of said locations;

(e) logic circuit means for receiving signals from said first and from second signal means and for transmitting a comparison signal to a comparator circuit, said comparison signal being initiated by a signal from said second signal means but only at such time that a signal is present from said first signal means;

(f) integrator circuit means for receiving and integrating said electrical signals from said measuring means and transmitting a signal representative of the length of strip passing into processing section; and (g) comparator circuit means for receiving and comparing the signals from said logic circuit means and said integrator circuit means and for transmitting a signal when the compared signals are equivalent to indicate that the portion of the strip at the first location when the strip was stopped has reached the second location.

14. A method of processing strand in a continuous strand processing line, which line includes an entry section having a work station, a processing section; and an accumulator section having a positionable accumulator downstream of said work station, which method comprises:

(a) accumulating a reserve of strand downstream of said entry section by suitably positioning said accumulator to supply sufficient strand to continue movement of the strand through said processing section despite halting movement of the strand at said work station;

(b) issuing a work signal when work is being performed on the strand at said work station;

(c) issuing an accumulator position signal representative of the position of the accumulator along its path;

(d) issuing a strand signal from which the strand length passing into said processing section may be ascertained;

(e) receiving said work and said accumulator position signals in a computation circuit;

(f) setting in said computation circuit a preset value representative of the strand path distance between said work station and a preselected position in said processing section, said preset value being compared with the length of strand passing into said processing section, the comparison being initiated only at such time that a position signal is issued and a work signal is preset; and (g) issuing a new output signal when the length of strand passing into said processing section corresponds to the length of said strand path distance.

15. A method of processing strip in a continuous strip processing line, which line includes an entry section having a work station, a processing section, and an accumulator section having a positionable accumulator downstream of said work station, which method comprises:

(a) accumulating a reserve of strip downstream of said entry section by suitably positioning said accumulator to supply sufficient strip to continue movement of the strip through said processing section despite halting movement of the strip at said work station;

(b) issuing a work signal indicating that movement of said strip has halted and work is being performed at said work station;

(c) sensing the presence of said accumulator at preselected positions and issuing a position signal to logic circuit means;

(d) issuing a signal from said logic circuit means to comparator circuit means and setting a preselected voltage in said comparator circuit means, said preset voltage being representative of length of the strip path between said work station and said processing section at the time said position signal is initiated;

(e) issuing a strip velocity signal to integrator circuit means, which signal is representative of the velocity of the strip in said processing section;

(f) integrating said strip velocity signal and issuing a strip length signal to said comparator circuit means for comparison with said preset voltage; and (g) issuing an output signal when the preset voltage in said comparator circuit means corresponds to the voltage signal from said integrator circuit means and thus providing an indication that the portion of the strip which had been at said work station when work was performed thereon has reached said processing section.

* * * * *

UNITED STATES PATENT AND TRADEMARK OFFICE

CERTIFICATE OF CORRECTION

PATENT NO. : 4,110,824

DATED : Aug. 29, 1978

INVENTOR(S) : Halsey et al

It is certified that error appears in the above-identified patent and that said Letters Patent are hereby corrected as shown below:

Col. 3, line 23, the first "(2)" should read --(1)--

Col. 3, line 51, the word "setion" should read --section--

Col. 7, line 9, "C-D" should read --CC-D--

Col. 7, line 31, "$D_x 32V_nT_n/2$" should read --$D_x = V_nT_n/2$--

Col. 8, line 1, the word "signal" should read --signals--

Col. 10, line 47, "$N - (V_xT_s/V_nT_n) \geqq 1$" should read --$N - (V_xT_s/V_nT_n) \leqq 1$--

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*